US009339438B2

(12) United States Patent
Lev et al.

(10) Patent No.: US 9,339,438 B2
(45) Date of Patent: May 17, 2016

(54) TELESCOPIC FEMALE DRUG VIAL ADAPTER

(71) Applicant: MEDIMOP Medical Projects Ltd., Ra'anana (IL)

(72) Inventors: Nimrod Lev, Savion (IL); Igor Denenburg, Gedera (IL); Mordechai Bukhman, Netanya (IL)

(73) Assignee: Medimop Medical Projects Ltd., Ra'anana (IL)

( * ) Notice: Subject to any disclaimer, the term of this patent is extended or adjusted under 35 U.S.C. 154(b) by 0 days.

(21) Appl. No.: 14/425,482

(22) PCT Filed: Oct. 17, 2012

(86) PCT No.: PCT/IL2012/050407

§ 371 (c)(1),
(2) Date: Mar. 3, 2015

(87) PCT Pub. No.: WO2014/041529

PCT Pub. Date: Mar. 20, 2014

(65) Prior Publication Data

US 2015/0231034 A1 Aug. 20, 2015

(30) Foreign Application Priority Data

Sep. 13, 2012 (IL) ..... 221920

(51) Int. Cl.
*A61J 1/20* (2006.01)

(52) U.S. Cl.
CPC ..... *A61J 1/2055* (2015.05); *A61J 1/2051* (2015.05); *A61J 1/2075* (2015.05); *A61J 1/2082* (2015.05)

(58) Field of Classification Search
CPC ..... A61J 1/2055; A61J 1/2051
See application file for complete search history.

(56) References Cited

U.S. PATENT DOCUMENTS

| | | | |
|---|---|---|---|
| 62,333 | A | 2/1867 | Holl |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,931,668 | A | 4/1960 | Baley |
| 2,968,497 | A | 1/1961 | Treleman |
| 3,059,643 | A | 10/1962 | Barton |

(Continued)

FOREIGN PATENT DOCUMENTS

| | | | |
|---|---|---|---|
| CN | 1950049 | A | 4/2007 |
| DE | 1913926 | A1 | 9/1970 |

(Continued)

OTHER PUBLICATIONS

U.S. Appl. No. 29/478,723 by Lev, filed Jan. 8, 2014.

(Continued)

*Primary Examiner* — Leslie Deak
*Assistant Examiner* — Kai Weng
(74) *Attorney, Agent, or Firm* — Panitch Schwarze Belisario & Nadel LLP

(57) ABSTRACT

A telescopic female drug vial adapter including a spike component telescopically mounted on a skirt component for snap fit on and puncturing a drug vial in an actuated position. The telescopic female drug vial adapter is particularly suitable for implementation in a vented version to avoid wetting of its air filter during aspiration of liquid contents from a drug vial.

5 Claims, 7 Drawing Sheets

(56) References Cited

U.S. PATENT DOCUMENTS

| | | | |
|---|---|---|---|
| D198,499 | S | 6/1964 | Harautuneian |
| 3,225,763 | A | 12/1965 | Waterman |
| 3,484,849 | A | 12/1969 | Huebner et al. |
| 3,618,637 | A | 11/1971 | Santomieri |
| 3,757,981 | A | 9/1973 | Harris, Sr. et al. |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,051,852 | A | 10/1977 | Villari |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Hudspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustavsson |
| 4,573,993 | A | 3/1986 | Hoag et al. |
| 4,576,211 | A | 3/1986 | Valentini et al. |
| 4,581,014 | A | 4/1986 | Millerd et al. |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| 4,804,366 | A | 2/1989 | Zdeb et al. |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |
| 5,312,377 | A | 5/1994 | Dalton |
| 5,328,474 | A | 7/1994 | Raines |
| D349,648 | S | 8/1994 | Tirrell et al. |
| 5,334,163 | A | 8/1994 | Sinnett |
| 5,334,179 | A | 8/1994 | Poli et al. |
| 5,342,346 | A | 8/1994 | Honda et al. |
| 5,344,417 | A | 9/1994 | Wadsworth, Jr. |
| 5,348,548 | A | 9/1994 | Meyer et al. |
| 5,350,372 | A | 9/1994 | Ikeda et al. |
| 5,364,386 | A | 11/1994 | Fukuoka et al. |
| 5,364,387 | A | 11/1994 | Sweeney |
| 5,374,264 | A | 12/1994 | Wadsworth, Jr. |
| 5,385,547 | A | 1/1995 | Wong et al. |
| 5,397,303 | A | 3/1995 | Sancoff et al. |
| D357,733 | S | 4/1995 | Matkovich |
| 5,429,614 | A | 7/1995 | Fowles et al. |
| 5,433,330 | A | 7/1995 | Yatsko et al. |
| 5,445,630 | A | 8/1995 | Richmond |
| 5,445,631 | A | 8/1995 | Uchida |
| D362,718 | S | 9/1995 | Deily et al. |
| 5,451,374 | A | 9/1995 | Molina |
| 5,454,805 | A | 10/1995 | Brony |
| 5,464,111 | A | 11/1995 | Vacek et al. |
| 5,464,123 | A | 11/1995 | Scarrow |
| 5,466,219 | A | 11/1995 | Lynn et al. |
| 5,466,220 | A | 11/1995 | Brenneman |
| 5,470,327 | A | 11/1995 | Helgren et al. |
| 5,471,994 | A | 12/1995 | Guirguis |
| 5,472,022 | A | 12/1995 | Michel et al. |

(56) References Cited

U.S. PATENT DOCUMENTS

| | | | |
|---|---|---|---|
| 5,478,337 | A | 12/1995 | Okamoto et al. |
| 5,492,147 | A | 2/1996 | Challender et al. |
| D369,406 | S | 4/1996 | Niedospial et al. |
| 5,505,714 | A | 4/1996 | Dassa et al. |
| 5,509,433 | A | 4/1996 | Paradis |
| 5,520,659 | A | 5/1996 | Hedges |
| 5,526,853 | A | 6/1996 | McPhee et al. |
| 5,527,306 | A | 6/1996 | Haining |
| 5,531,695 | A | 7/1996 | Swisher |
| 5,547,471 | A | 8/1996 | Thompson et al. |
| 5,549,577 | A | 8/1996 | Siegel et al. |
| 5,554,128 | A | 9/1996 | Hedges |
| 5,566,729 | A | 10/1996 | Grabenkort et al. |
| 5,569,191 | A | 10/1996 | Meyer |
| 5,573,281 | A | 11/1996 | Keller |
| 5,578,015 | A | 11/1996 | Robb |
| 5,583,052 | A | 12/1996 | Portnoff et al. |
| 5,584,819 | A | 12/1996 | Kopfer |
| 5,591,143 | A | 1/1997 | Trombley, III et al. |
| 5,603,706 | A | 2/1997 | Wyatt et al. |
| 5,607,439 | A | 3/1997 | Yoon |
| 5,611,576 | A | 3/1997 | Guala |
| 5,616,203 | A | 4/1997 | Stevens |
| 5,636,660 | A | 6/1997 | Pfleiderer et al. |
| 5,637,101 | A | 6/1997 | Shillington |
| 5,641,010 | A | 6/1997 | Maier |
| 5,645,538 | A | 7/1997 | Richmond |
| 5,647,845 | A | 7/1997 | Haber et al. |
| 5,651,776 | A | 7/1997 | Appling et al. |
| 5,653,686 | A | 8/1997 | Coulter et al. |
| 5,674,195 | A | 10/1997 | Truthan |
| 5,676,346 | A | 10/1997 | Leinsing |
| 5,685,845 | A | 11/1997 | Grimard |
| D388,172 | S | 12/1997 | Cipes |
| 5,699,821 | A | 12/1997 | Paradis |
| 5,702,019 | A | 12/1997 | Grimard |
| 5,718,346 | A | 2/1998 | Weiler |
| D393,722 | S | 4/1998 | Fangrow, Jr. et al. |
| 5,738,144 | A | 4/1998 | Rogers |
| 5,743,312 | A | 4/1998 | Pfeifer et al. |
| 5,746,733 | A | 5/1998 | Capaccio et al. |
| 5,755,696 | A | 5/1998 | Caizza |
| 5,766,211 | A | 6/1998 | Wood et al. |
| 5,772,630 | A | 6/1998 | Ljungquist |
| 5,772,652 | A | 6/1998 | Zielinski |
| RE35,841 | E | 7/1998 | Frank et al. |
| 5,776,116 | A | 7/1998 | Lopez et al. |
| 5,782,872 | A | 7/1998 | Muller |
| 5,806,831 | A | 9/1998 | Paradis |
| 5,810,792 | A | 9/1998 | Fangrow, Jr. et al. |
| D399,559 | S | 10/1998 | Molina |
| 5,817,082 | A | 10/1998 | Niedospial, Jr. et al. |
| 5,820,621 | A | 10/1998 | Yale et al. |
| 5,827,262 | A | 10/1998 | Neftel et al. |
| 5,832,971 | A | 11/1998 | Yale et al. |
| 5,833,213 | A | 11/1998 | Ryan |
| 5,834,744 | A | 11/1998 | Risman |
| 5,839,715 | A | 11/1998 | Leinsing |
| 5,853,406 | A | 12/1998 | Masuda et al. |
| D405,522 | S | 2/1999 | Hoenig et al. |
| 5,871,110 | A | 2/1999 | Grimard et al. |
| 5,873,872 | A | 2/1999 | Thibault et al. |
| 5,879,337 | A | 3/1999 | Kuracina et al. |
| 5,879,345 | A | 3/1999 | Aneas |
| 5,887,633 | A | 3/1999 | Yale et al. |
| 5,890,610 | A | 4/1999 | Jansen et al. |
| 5,891,129 | A | 4/1999 | Daubert et al. |
| 5,893,397 | A | 4/1999 | Peterson et al. |
| 5,897,526 | A | 4/1999 | Vaillancourt |
| 5,899,468 | A | 5/1999 | Apps et al. |
| 5,902,280 | A | 5/1999 | Powles et al. |
| 5,902,298 | A | 5/1999 | Niedospial, Jr. et al. |
| D410,740 | S | 6/1999 | Molina |
| 5,911,710 | A | 6/1999 | Barry et al. |
| 5,919,182 | A | 7/1999 | Avallone |
| 5,921,419 | A | 7/1999 | Niedospial, Jr. et al. |
| 5,924,584 | A | 7/1999 | Hellstrom et al. |
| 5,925,029 | A | 7/1999 | Jansen et al. |
| 5,935,112 | A | 8/1999 | Stevens et al. |
| 5,941,848 | A | 8/1999 | Nishimoto et al. |
| 5,944,700 | A | 8/1999 | Nguyen et al. |
| 5,954,104 | A | 9/1999 | Daubert et al. |
| 5,971,181 | A | 10/1999 | Niedospial, Jr. et al. |
| 5,971,965 | A | 10/1999 | Mayer |
| 5,989,237 | A | 11/1999 | Fowles et al. |
| 6,003,566 | A | 12/1999 | Thibault et al. |
| 6,004,278 | A | 12/1999 | Botich et al. |
| 6,019,750 | A | 2/2000 | Fowles et al. |
| 6,022,339 | A | 2/2000 | Fowles et al. |
| 6,036,171 | A | 3/2000 | Weinheimer et al. |
| 6,039,093 | A | 3/2000 | Mrotzek et al. |
| 6,039,302 | A | 3/2000 | Cote, Sr. et al. |
| D422,357 | S | 4/2000 | Niedospial, Jr. et al. |
| 6,063,068 | A | 5/2000 | Fowles et al. |
| D427,308 | S | 6/2000 | Zinger |
| D427,309 | S | 6/2000 | Molina |
| 6,070,623 | A | 6/2000 | Aneas |
| 6,071,270 | A | 6/2000 | Fowles et al. |
| 6,080,132 | A | 6/2000 | Cole et al. |
| D428,141 | S | 7/2000 | Brotspies et al. |
| 6,086,762 | A | 7/2000 | Guala |
| 6,089,541 | A | 7/2000 | Weinheimer et al. |
| 6,090,091 | A | 7/2000 | Fowles et al. |
| 6,090,093 | A | 7/2000 | Thibault et al. |
| 6,092,692 | A | 7/2000 | Riskin |
| D430,291 | S | 8/2000 | Jansen et al. |
| 6,099,511 | A | 8/2000 | Devos et al. |
| 6,113,068 | A | 9/2000 | Ryan |
| 6,113,583 | A | 9/2000 | Fowles et al. |
| 6,117,114 | A | 9/2000 | Paradis |
| D431,864 | S | 10/2000 | Jansen |
| 6,139,534 | A | 10/2000 | Niedospial, Jr. et al. |
| 6,142,446 | A | 11/2000 | Leinsing |
| 6,146,362 | A | 11/2000 | Turnbull et al. |
| 6,149,623 | A | 11/2000 | Reynolds |
| 6,156,025 | A | 12/2000 | Niedospial, Jr. et al. |
| 6,159,192 | A | 12/2000 | Fowles et al. |
| 6,168,037 | B1 | 1/2001 | Grimard |
| 6,171,287 | B1 | 1/2001 | Lynn et al. |
| 6,171,293 | B1 | 1/2001 | Rowley et al. |
| 6,173,852 | B1 | 1/2001 | Browne |
| 6,173,868 | B1 | 1/2001 | DeJonge |
| 6,174,304 | B1 | 1/2001 | Weston |
| 6,179,822 | B1 | 1/2001 | Niedospial, Jr. |
| 6,179,823 | B1 | 1/2001 | Niedospial, Jr. |
| 6,206,861 | B1 | 3/2001 | Mayer |
| 6,221,041 | B1 | 4/2001 | Russo |
| 6,221,054 | B1 | 4/2001 | Martin et al. |
| 6,221,065 | B1 | 4/2001 | Davis |
| 6,238,372 | B1 | 5/2001 | Zinger et al. |
| 6,245,044 | B1 | 6/2001 | Daw et al. |
| D445,501 | S | 7/2001 | Niedospial, Jr. |
| D445,895 | S | 7/2001 | Svendsen |
| 6,253,804 | B1 | 7/2001 | Safabash |
| 6,258,078 | B1 | 7/2001 | Thilly |
| 6,280,430 | B1 | 8/2001 | Neftel et al. |
| 6,290,688 | B1 | 9/2001 | Lopez et al. |
| 6,296,621 | B1 | 10/2001 | Masuda et al. |
| 6,299,131 | B1 | 10/2001 | Ryan |
| 6,343,629 | B1 | 2/2002 | Wessman et al. |
| 6,348,044 | B1 | 2/2002 | Coletti et al. |
| 6,358,236 | B1 | 3/2002 | DeFoggi et al. |
| 6,364,866 | B1 | 4/2002 | Furr et al. |
| 6,378,576 | B2 | 4/2002 | Thibault et al. |
| 6,378,714 | B1 | 4/2002 | Jansen et al. |
| 6,379,340 | B1 | 4/2002 | Zinger et al. |
| D457,954 | S | 5/2002 | Wallace et al. |
| 6,382,442 | B1 | 5/2002 | Thibault et al. |
| 6,386,397 | B2 | 5/2002 | Brotspies et al. |
| 6,408,897 | B1 | 6/2002 | Laurent et al. |
| 6,409,708 | B1 | 6/2002 | Wessman |
| 6,440,107 | B1 | 8/2002 | Trombley, III et al. |
| 6,453,949 | B1 | 9/2002 | Chau |
| 6,453,956 | B2 | 9/2002 | Safabash |

(56) References Cited

U.S. PATENT DOCUMENTS 6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Arnissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
7,611,487 B2 11/2009 Woehr et al.
7,611,502 B2 11/2009 Daly
7,615,041 B2 11/2009 Sullivan et al.
7,628,779 B2 12/2009 Aneas
7,632,261 B2 12/2009 Zinger et al.
D608,900 S 1/2010 Giraud et al.
7,654,995 B2 2/2010 Warren et al.
7,670,326 B2 3/2010 Shemesh
7,695,445 B2 4/2010 Yuki
D616,090 S 5/2010 Kawamura
7,713,247 B2 5/2010 Lopez
7,717,886 B2 5/2010 Lopez
7,722,090 B2 5/2010 Burton et al.
D616,984 S 6/2010 Gilboa
7,731,678 B2 6/2010 Tennican et al.
7,743,799 B2 6/2010 Mosler et al.
7,744,581 B2 6/2010 Wallen et al.
7,757,901 B2 7/2010 Welp
7,758,082 B2 7/2010 Weigel et al.
7,762,524 B2 7/2010 Cawthon et al.
7,766,304 B2 8/2010 Phillips
7,771,383 B2 8/2010 Truitt et al.
D624,641 S 9/2010 Boclet
7,799,009 B2 9/2010 Niedospial, Jr. et al.
7,803,140 B2 9/2010 Fangrow, Jr.
D627,216 S 11/2010 Fulginiti
D630,732 S 1/2011 Lev et al.
7,862,537 B2 1/2011 Zinger et al.
7,867,215 B2 1/2011 Akerlund et al.
7,879,018 B2 2/2011 Zinger et al.
D634,007 S 3/2011 Zinger et al.
7,900,659 B2 3/2011 Whitley et al.
D637,713 S 5/2011 Nord et al.
D641,080 S 7/2011 Zinger et al.
7,985,216 B2 7/2011 Daily et al.
D644,104 S 8/2011 Maeda et al.
7,993,328 B2 8/2011 Whitley
8,007,461 B2 8/2011 Huo et al.
8,012,132 B2 9/2011 Lum et al.
8,016,809 B2 9/2011 Zinger et al.
8,021,325 B2 9/2011 Zinger et al.
8,025,653 B2 9/2011 Capitaine et al.
8,029,472 B2 10/2011 Leinsing et al.
8,038,123 B2 10/2011 Ruschke et al.
8,066,688 B2 11/2011 Zinger et al.
8,070,739 B2 12/2011 Zinger et al.

(56) References Cited

U.S. PATENT DOCUMENTS

| | | | |
|---|---|---|---|
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| D673,673 | S | 1/2013 | Wang |
| D674,088 | S | 1/2013 | Lev et al. |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| D738,494 | S | 9/2015 | Kashmirian |
| D750,235 | S | 2/2016 | Maurice |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0121496 | A1 | 9/2002 | Thiebault et al. |
| 2002/0123736 | A1 | 9/2002 | Fowles et al. |
| 2002/0127150 | A1 | 9/2002 | Sasso |
| 2002/0128628 | A1 | 9/2002 | Fathallah |
| 2002/0138045 | A1 | 9/2002 | Moen |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0073971 | A1 | 4/2003 | Saker |
| 2003/0100866 | A1 | 5/2003 | Reynolds |
| 2003/0109846 | A1 | 6/2003 | Zinger et al. |
| 2003/0120209 | A1 | 6/2003 | Jensen et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199846 | A1 | 10/2003 | Fowles et al. |
| 2003/0199847 | A1 | 10/2003 | Akerlund et al. |
| 2004/0024354 | A1 | 2/2004 | Reynolds |
| 2004/0039365 | A1 | 2/2004 | Aramata et al. |
| 2004/0044327 | A1 | 3/2004 | Hasegawa |
| 2004/0073189 | A1 | 4/2004 | Wyatt et al. |
| 2004/0143226 | A1 | 7/2004 | Marsden |
| 2004/0153047 | A1 | 8/2004 | Blank et al. |
| 2004/0181192 | A1 | 9/2004 | Cuppy |
| 2004/0204699 | A1 | 10/2004 | Hanly et al. |
| 2004/0217315 | A1 | 11/2004 | Doyle |
| 2004/0225274 | A1 | 11/2004 | Jansen et al. |
| 2004/0236305 | A1 | 11/2004 | Jansen et al. |
| 2004/0255952 | A1 | 12/2004 | Carlsen et al. |
| 2005/0015070 | A1 | 1/2005 | Delnevo et al. |
| 2005/0016626 | A1 | 1/2005 | Wilcox et al. |
| 2005/0055008 | A1 | 3/2005 | Paradis et al. |
| 2005/0082828 | A1 | 4/2005 | Wicks et al. |
| 2005/0124964 | A1 | 6/2005 | Niedospial et al. |
| 2005/0137566 | A1 | 6/2005 | Fowles et al. |
| 2005/0148994 | A1 | 7/2005 | Leinsing |
| 2005/0159724 | A1 | 7/2005 | Enerson |
| 2005/0182383 | A1 | 8/2005 | Wallen |
| 2005/0209554 | A1 | 9/2005 | Landau |
| 2005/0261637 | A1 | 11/2005 | Miller |
| 2005/0277896 | A1 | 12/2005 | Messerli et al. |
| 2006/0030832 | A1 | 2/2006 | Niedospial et al. |
| 2006/0079834 | A1 | 4/2006 | Tennican et al. |
| 2006/0089594 | A1 | 4/2006 | Landau |
| 2006/0089603 | A1 | 4/2006 | Truitt et al. |
| 2006/0095015 | A1 | 5/2006 | Hobbs et al. |
| 2006/0106360 | A1 | 5/2006 | Wong |
| 2006/0135948 | A1 | 6/2006 | Varma |
| 2006/0155257 | A1 | 7/2006 | Reynolds |
| 2006/0253084 | A1 | 11/2006 | Nordgren |
| 2007/0024995 | A1 | 2/2007 | Hayashi |
| 2007/0060904 | A1 | 3/2007 | Vedrine et al. |
| 2007/0079894 | A1 | 4/2007 | Kraus et al. |
| 2007/0083164 | A1 | 4/2007 | Barrelle et al. |
| 2007/0088252 | A1 | 4/2007 | Pestotnik et al. |
| 2007/0088293 | A1 | 4/2007 | Fangrow |
| 2007/0088313 | A1 | 4/2007 | Zinger et al. |
| 2007/0106244 | A1 | 5/2007 | Mosler et al. |
| 2007/0112324 | A1 | 5/2007 | Hamedi-Sangsari |
| 2007/0156112 | A1 | 7/2007 | Walsh |
| 2007/0167904 | A1 | 7/2007 | Zinger et al. |
| 2007/0191760 | A1 | 8/2007 | Iguchi et al. |
| 2007/0191764 | A1 | 8/2007 | Zihlmann |
| 2007/0191767 | A1 | 8/2007 | Hennessy et al. |
| 2007/0203451 | A1 | 8/2007 | Murakami et al. |
| 2007/0219483 | A1 | 9/2007 | Kitani et al. |
| 2007/0244447 | A1 | 10/2007 | Capitaine et al. |
| 2007/0244461 | A1 | 10/2007 | Fangrow |
| 2007/0244462 | A1 | 10/2007 | Fangrow |
| 2007/0244463 | A1 | 10/2007 | Warren et al. |
| 2007/0249995 | A1 | 10/2007 | Van Manen |
| 2007/0255202 | A1 | 11/2007 | Kitani et al. |
| 2007/0265574 | A1 | 11/2007 | Tennican et al. |
| 2007/0265581 | A1 | 11/2007 | Funamura et al. |
| 2007/0270778 | A9 | 11/2007 | Zinger et al. |
| 2007/0287953 | A1 | 12/2007 | Ziv et al. |
| 2007/0299404 | A1 | 12/2007 | Katoh et al. |
| 2008/0009789 | A1 | 1/2008 | Zinger et al. |
| 2008/0009822 | A1 | 1/2008 | Enerson |
| 2008/0135051 | A1 | 6/2008 | Lee |
| 2008/0172024 | A1 | 7/2008 | Yow |

(56) References Cited

U.S. PATENT DOCUMENTS

| | | | |
|---|---|---|---|
| 2008/0188799 | A1 | 8/2008 | Mueller-Beckhaus et al. |
| 2008/0249479 | A1 | 10/2008 | Zinger et al. |
| 2008/0249498 | A1 | 10/2008 | Fangrow |
| 2008/0262465 | A1 | 10/2008 | Zinger et al. |
| 2008/0287905 | A1 | 11/2008 | Hiejima et al. |
| 2008/0294100 | A1 | 11/2008 | de Costa et al. |
| 2008/0306439 | A1 | 12/2008 | Nelson et al. |
| 2008/0312634 | A1 | 12/2008 | Helmerson et al. |
| 2009/0012492 | A1 | 1/2009 | Zihlmann |
| 2009/0082750 | A1 | 3/2009 | Denenburg et al. |
| 2009/0143758 | A1 | 6/2009 | Okiyama |
| 2009/0177177 | A1 | 7/2009 | Zinger et al. |
| 2009/0177178 | A1 | 7/2009 | Pedersen |
| 2009/0187140 | A1 | 7/2009 | Racz |
| 2009/0216212 | A1 | 8/2009 | Fangrow, Jr. |
| 2009/0267011 | A1 | 10/2009 | Hatton et al. |
| 2009/0299325 | A1 | 12/2009 | Vedrine et al. |
| 2009/0326506 | A1 | 12/2009 | Hasegawa et al. |
| 2010/0010443 | A1 | 1/2010 | Morgan et al. |
| 2010/0022985 | A1 | 1/2010 | Sullivan et al. |
| 2010/0030181 | A1 | 2/2010 | Helle et al. |
| 2010/0036319 | A1 | 2/2010 | Drake et al. |
| 2010/0076397 | A1 | 3/2010 | Reed et al. |
| 2010/0087786 | A1 | 4/2010 | Zinger et al. |
| 2010/0137827 | A1 | 6/2010 | Warren et al. |
| 2010/0160889 | A1 | 6/2010 | Smith et al. |
| 2010/0168664 | A1 | 7/2010 | Zinger et al. |
| 2010/0168712 | A1 | 7/2010 | Tuckwell et al. |
| 2010/0179506 | A1 | 7/2010 | Shemesh et al. |
| 2010/0198148 | A1 | 8/2010 | Zinger et al. |
| 2010/0204670 | A1 | 8/2010 | Kraushaar et al. |
| 2010/0241088 | A1 | 9/2010 | Ranalletta et al. |
| 2010/0274184 | A1 | 10/2010 | Chun |
| 2010/0286661 | A1 | 11/2010 | Raday et al. |
| 2010/0312220 | A1 | 12/2010 | Kalitzki |
| 2011/0004184 | A1 | 1/2011 | Proksch et al. |
| 2011/0054440 | A1 | 3/2011 | Lewis |
| 2011/0087164 | A1 | 4/2011 | Mosler et al. |
| 2011/0160701 | A1 | 6/2011 | Wyatt et al. |
| 2011/0175347 | A1 | 7/2011 | Okiyama |
| 2011/0218511 | A1 | 9/2011 | Yokoyama |
| 2011/0224640 | A1 | 9/2011 | Kuhn et al. |
| 2011/0230856 | A1 | 9/2011 | Kyle et al. |
| 2011/0264037 | A1 | 10/2011 | Foshee et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022469 | A1 | 1/2012 | Alpert |
| 2012/0053555 | A1 | 3/2012 | Ariagno et al. |
| 2012/0059346 | A1 | 3/2012 | Sheppard et al. |
| 2012/0067429 | A1 | 3/2012 | Mosler et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev et al. |
| 2012/0265163 | A1 | 10/2012 | Cheng et al. |
| 2012/0271229 | A1 | 10/2012 | Lev et al. |
| 2012/0296307 | A1 | 11/2012 | Holt et al. |
| 2012/0310203 | A1 | 12/2012 | Khaled et al. |
| 2012/0323187 | A1 | 12/2012 | Iwase et al. |
| 2012/0323210 | A1 | 12/2012 | Lev et al. |
| 2013/0046269 | A1 | 2/2013 | Lev et al. |
| 2013/0053814 | A1 | 2/2013 | Mueller-Beckhaus et al. |
| 2013/0096493 | A1 | 4/2013 | Kubo et al. |
| 2013/0144248 | A1 | 6/2013 | Putter et al. |
| 2013/0199669 | A1 | 8/2013 | Moy et al. |
| 2013/0226100 | A1 | 8/2013 | Lev |
| 2013/0231630 | A1 | 9/2013 | Kraus et al. |
| 2013/0237904 | A1 | 9/2013 | Deneburg et al. |
| 2013/0289530 | A1 | 10/2013 | Wyatt et al. |
| 2014/0020793 | A1 | 1/2014 | Denenburg et al. |
| 2014/0096862 | A1 | 4/2014 | Aneas |
| 2014/0150911 | A1 | 6/2014 | Hanner et al. |
| 2014/0352845 | A1 | 12/2014 | Lev et al. |
| 2015/0082746 | A1 | 3/2015 | Ivosevic et al. |
| 2015/0088078 | A1 | 3/2015 | Lev et al. |

FOREIGN PATENT DOCUMENTS

| | | | |
|---|---|---|---|
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0518397 | A1 | 12/1992 |
| EP | 0521460 | A1 | 1/1993 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-097253 | A | 4/2004 |
| JP | 2004-522541 | A | 7/2004 |
| JP | 2010-179128 | A | 8/2010 |
| WO | 8601712 | A1 | 3/1986 |
| WO | 9003536 | A1 | 4/1990 |
| WO | 9403373 | A1 | 2/1994 |
| WO | 9507066 | A1 | 3/1995 |

(56) References Cited

FOREIGN PATENT DOCUMENTS

| | | | |
|---|---|---|---|
| WO | 9600053 | A1 | 1/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0191693 | A2 | 12/2001 |
| WO | 0209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010117580 | A1 | 10/2010 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011104711 | A1 | 9/2011 |
| WO | 2012063230 | A1 | 5/2012 |
| WO | 2012143921 | A1 | 10/2012 |
| WO | 2013127813 | A1 | 9/2013 |
| WO | 2013134246 | A1 | 9/2013 |
| WO | 2013156944 | A1 | 10/2013 |
| WO | 2014033706 | A2 | 3/2014 |
| WO | 2014033710 | A1 | 3/2014 |

OTHER PUBLICATIONS

U.S. Appl. No. 29/478,726 by Lev, filed Jan. 8, 2014.
Office Action issued Jan. 2, 2014 in U.S. Appl. No. 13/505,881 by Lev.
Int'l Preliminary Report on Patentability issued Sep. 24, 2013 in Int'l Application No. PCT/IL2012/000354.
Office Action issued Feb. 13, 2014 in U.S. Appl. No. 13/884,981 by Denenburg.
U.S. Appl. No. 14/345,094 by Lev, filed Mar. 14, 2014.
Int'l Search Report and Written Opinion issued Jan. 7, 2014 in Int'l Application No. PCT/IL2012/050721.
English translation of an Office Action issued Jan. 9, 2014 in JP Application No. 2010-526421.
English translation of an Office Action issued Dec. 4, 2013 in CN Application No. 201080051210.3.
English translation of an Office Action issued Dec. 25, 2013 in CN Application No. 201180006530.1.
Office Action issued Nov. 28, 2013 in IN Application No. 4348/DELNP/2008.
Office Action issued Oct. 8, 2013 in CN Application No. 201080043825.1.
English translation of an Office Action issued Feb. 4, 2014 in JP Application No. 2012-554468.
Office Action issued Jan. 17, 2014 in CN Application No. 201180006534.X.
Int'l Search Report and Written Opinion issued May 8, 2014 in Int'l Application No. PCT/IL2013/050706.
English translation of an Office Action issued Apr. 28, 2014 in JP Application No. 2013-537257.
Int'l Preliminary Report on Patentability issued Jan. 14, 2014 in Int'l Application No. PCT/IL2012/050516.
Office Action issued May 6, 2014 in U.S. Appl. No. 13/505,881 by Lev.
U.S. Appl. No. 14/366,306 by Lev, filed Jun. 18, 2014.
Office Action issued Apr. 17, 2014 in CN Application No. 201080051201.4.
Int'l Search Report and Written Opinion issued Jul. 16, 2014 in Int'l Application No. PCT/IL2014/050327.
English translation of an Office Action issued Jun. 30, 2014 in CN Application No. 201180052962.6.
Extended European Search Report issued Jun. 3, 2014 in EP Application No. 08781828.2.
Written Opinion issued Jul. 1, 2013 in Int'l Application No. PCT/IL2013/050180.
Int'l Preliminary Report on Patentability issued Apr. 1, 2014 in Int'l Application No. PCT/IL2013/050180.
Written Opinion issued Jul. 31, 2013 in Int'l Application No. PCT/IL2013/050313.
Int'l Preliminary Report on Patentability issued May 12, 2014 in Int'l Application No. PCT/IL2013/050316.
Office Action issued Jul. 31, 2014 in U.S. Appl. No. 29/438,141 by Gilboa.
U.S. Appl. No. 14/385,212 by Lev, filed Sep. 15, 2014.
U.S. Appl. No. 29/502,037 by Lev, filed Sep. 11, 2014.
U.S. Appl. No. 29/502,053 by Lev, filed Sep. 11, 2014.
U.S. Appl. No. 14/391,792 by Lev, filed Oct. 10, 2014.
U.S. Appl. No. 14/504,979 by Lev, filed Oct. 2, 2014.
Int'l Search Report and Written Opinion issued Sep. 2, 2014 in Int'l Application No. PCT/IL2014/050405.
Int'l Search Report and Written Opinion issued Oct. 17, 2014 in Int'l Application No. PCT/IL2014/050680.
English translation of an Office Action issued Aug. 28, 2014 in JP Application No. 2013-168885.
Written Opinion issued Jun. 5, 2013 in Int'l Application No. PCT/IL2012/050407.
Int'l Preliminary Report on Patentability issued Aug. 20, 2014 in Int'l Application No. PCT/IL2012/050407.
Office Action issued Mar. 17, 2015 in U.S. Appl. No. 14/504,979 by Lev.
Office Action issued Apr. 9, 2015 in U.S. Appl. No. 13/883,289 by Lev.
Office Action issued May 28, 2015 in U.S. Appl. No. 14/391,792 by Lev.
Office Action issued Aug. 24, 2015 in U.S. Appl. No. 14/366,306 by Lev.
Office Action issued Mar. 10, 2015 in EP Application No. 12 812 395.7.
Office Action issued Aug. 7, 2015 in JP Application No. 2015-529206.
Written Opinion issued Apr. 10, 2015 in Int'l Application No. PCT/IL2014/050405.
Response to Written Opinion dated Mar. 9, 2015 in Int'l Application No. PCT/IL2014/050405.
Int'l Preliminary Report on Patentability issued Aug. 24, 2015 in Int'l Application No. PCT/IL2014/050405.
U.S. Appl. No. 14/888,590 by Marks, filed Nov. 2, 2015.
U.S. Appl. No. 14/784,300 by Lev, filed Oct. 14, 2015.
Office Action issued Oct. 5, 2015 in U.S. Appl. No. 14/385,212 by Lev.
U.S. Appl. No. 29/544,969 by Ben Shalom, filed Nov. 9, 2015.
Office Action issued Mar. 6, 2012 in U.S. Appl. No. 12/678,928.

(56) References Cited

OTHER PUBLICATIONS

Int'l Search Report issued Feb. 3, 2011 in Int'l Application No. PCT/IL2010/000777; Written Opinion.
Int'l Search Report issued Mar. 17, 2011 in Int'l Application No. PCT/IL2010/000854; Written Opinion.
Int'l Search Report issued Mar. 17, 2011 in Int'l Application No. PCT/IL2010/000915; Written Opinion.
U.S. Appl. No. 13/505,790 by Lev, filed May 3, 2012.
U.S. Appl. No. 13/505,881 by Lev, filed May 3, 2012.
U.S. Appl. No. 13/522,410 by Lev, filed Jul. 16, 2012.
U.S. Appl. No. 13/576,461 by Lev, filed Aug. 1, 2012.
Office Action issued Jun. 14, 2012 in U.S. Appl. No. 29/376,980.
Office Action issued Jun. 15, 2012 in U.S. Appl. No. 29/413,170.
Office Action issued Jun. 21, 2012 in U.S. Appl. No. 12/596,167.
Alaris Medical Systems Product Brochure, 4 pages, Issue 1, Oct. 11, 1999.
Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ULTRASITE.RTM. Valve, B. Braun Medical, Inc. website and product description, 3 pages, Feb. 2006.
Int'l Search Report issued Aug. 16, 2012 in Int'l Application No. PCT/IL2012/000164.
U.S. Appl. No. 29/438,134 by Lev, filed Nov. 27, 2012.
U.S. Appl. No. 29/438,141 by Gilboa, filed Nov. 27, 2012.
Int'l Search Report issued Jan. 22, 2013 in Int'l Application No. PCT/IL2012/000354.
Int'l Search Report issued Mar. 18, 2013 in Int'l Application No. PCT/IL2012/050516.
Office Action issued Apr. 2, 2013 in U.S. Appl. No. 13/505,790.
Int'l Search Report and Written Opinion issued Mar. 6, 2012 in Int'l Application No. PCT/IL2011/000834.
U.S. Appl. No. 13/883,289 by Lev, filed May 3, 2013.
Int'l Search Report & Written Opinion issued on Mar. 7, 2012 in Int'l Application No. PCT/IL2011/000829.
U.S. Appl. No. 13/884,981 by Denenburg, filed May 13, 2013.
Office Action issued May 31, 2013 in U.S. Appl. No. 13/505,790.
Int'l Search Report issued Jun. 5, 2013 in Int'l Application No. PCT/IL2012/050407.
Int'l Search Report issued Jun. 19, 2013 in Int'l Application No. PCT/IL2013/050167.
Int'l Search Report issued Jul. 1, 2013 in Int'l Application No. PCT/IL2013/050180.
Int'l Search Report issued Jul. 31, 2013 in Int'l Application No. PCT/IL2013/050313.
Int'l Search Report issued Jul. 26, 2013 in Int'l Application No. PCT/IL2013/050316.
English translation of an Office Action issued Jun. 19, 2013 in JP Application No. 2012-531551.
Office Action issued Aug. 20, 2013 in U.S. Appl. No. 13/576,461 by Lev.
Int'l Preliminary Report on Patentability issued Aug. 28, 2012 in Int'l Application No. PCT/IL2011/000186.
English translation of an Office Action issued Jul. 26, 2013 in JP Application No. 2012-538464.
International Search Report Issued Jan. 23, 2007 in Int'l Application No. PCT/IL/2006/001228.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Drug Administration Systems product information sheets; http://www.westpharma.com/eu/en/products/Pages/Vial2Bag.aspx; pp. 1-3 (admitted prior art).
Office Action Issued Jun. 8, 2010 in U.S. Appl. No. 12/112,490 by Zinger.
Office Action issued Sep. 28, 2010 in U.S. Appl. No. 12/112,490 by Zinger.
Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007.html.> (7 pages. see pp. 5-6).
Office Action issued Jun. 15, 2011 in JP Application No. 2008-538492.
Translation of Office Action issued Jun. 18, 2012 in JP Application No. 2008-538492.
Translation of Office Action issued Apr. 15, 2013 in JP Application No. 2008-538492.
Office Action issued Jul. 13, 2012 in U.S. Appl. No. 12/112,490 by Zinger.
Office Action issued Jan. 23, 2013 in U.S. Appl. No. 12/112,490 by Zinger.
Int'l Preliminary Report on Patentability issued May 6, 2008 in Int'l Application No. PCT/IL2006/001228.
Written Opinion issued Aug. 16, 2012 in Int'l Application No. PCT/IL2012/000164.
English translation of an Office Action issued Sep. 10, 2013 in JP Application No. 2012-554468.
Office Action issued Nov. 11, 2013 in IL Application No. 218730.
Grifols Vial Adapter Product Literature, 2 pages, Jan. 2002. cited by other.
Novel Transfer, Mixing and Drug Delivery Systems, MOP Medimop Medical Projects Ltd. Catalog, 4 pages, Rev. 4, 2004. cited by other.
Office Action Issued Oct. 6, 2003 in U.S. Appl. No. 10/062,796.
Office Action Issued Feb. 22, 2005 in U.S. Appl. No. 10/062,796.
Office Action Issued Oct. 5, 2005 in U.S. Appl. No. 10/062,796.
Office Action Issued Feb. 20, 2009 in U.S. Appl. No. 11/694,297.
Int'l Search Report Issued Dec. 6, 2006 in Int'l Application No. PCT/IL2006/000912.
Int'l Preliminary Report on Patentability Issued Dec. 4, 2007 in Int'l Application No. PCT/IL2006/000912.
http://www.westpharma.com/en/products/Pages/Mixject.aspx (admitted prior art).
http://www.westpharma.com/SiteCollectionDocuments/Recon/mixject%20product%20sheet.pdf; MIXJECT product information sheet pp. 1. (admitted prior art).
Int'l Search Report Issued Jul. 27, 2007 in Int'l Application No. PCT/IL2007/000343.
Int'l Preliminary Report on Patentability Issued Jun. 19, 2008 in Int'l Application No. PCT/IL2007/000343.
Int'l Search Report Issued Mar. 27, 2009 in Int'l Application No. PCT/US2008/070024.
Int'l Search Report Issued Oct. 17, 2005 in Int'l Application No. PCT/IL2005/000376.
Int'l Preliminary Report on Patentability Issued Jun. 19, 2006 in Int'l Application No. PCT/IL2005/000376.
Written Opinion of ISR Issued Jun. 19, 2006 in Int'l Application No. PCT/IL2005/000376.
Int'l Search Report Issued Aug. 25, 2008 in Int'l Application No. PCT/IL2008/000517.
Written Opinion of the ISR Issued Oct. 17, 2009 in Int'l Application No. PCT/IL08/00517.
Int'l Preliminary Report on Patenability Issued Oct. 20, 2009 in Int'l Application No. PCT/IL2008/000517.
Written Opinion of the Int'l Searching Authority Issued Oct. 27, 2008 in Int'l Application No. PCT/US2008/070024.
Int'l Search Report Issued Mar. 12, 2009 in Int'l Application No. PCT/IL2008/001278.
Office Action Issued Jan. 20, 2010 in JP Application No. 2007-510229.
Office Action Issued Apr. 20, 2010 in U.S. Appl. No. 11/997,569.
Int'l Search Report dated Nov. 20, 2006 in Int'l Application No. PCT/IL2006/000881.
Office Action Issued May 27, 2010 in U.S. Appl. No. 11/559,152.
Decision to Grant mailed Apr. 12, 2010 in EP Application No. 08738307.1.
Office Action issued Jun. 1, 2010 in U.S. Appl. No. 11/568,421.
Office Action issued Nov. 12, 2010 in U.S. Appl. No. 29/334,697.
The MixJect transfer system, as shown in the article, "Advanced Delivery Devices," Drug Delivery Technology Jul./Aug. 2007 vol. 7

(56) References Cited

OTHER PUBLICATIONS

No. 7 [on-line]. [Retrieved from Internet May 14, 2010.] URL: <http://www.drugdeiverytech-online.com/drugdelivery/200707/?pg=28pg28>. (3 pages).
Publication date of Israeli Patent Application 186290 [on-line]. ]Retrieved from Internet May 24, 2010]. URL:<http://www.ilpatsearch.justrice.gov.il/UI/RequestsList.aspx>. (1 page).
Int'l Search Report issued Nov. 25, 2010 in Int'l Application No. PCT/IL2010/000530.
Office Action issued Feb. 7, 2011 in U.S. Appl. No. 12/783,194.
Office Action issued Dec. 20, 2010 in U.S. Appl. No. 12/063,176.
Office Action issued Dec. 13, 2010 in U.S. Appl. No. 12/293,122.
Office Action issued Nov. 29, 2010 in U.S. Appl. No. 11/568,421.
Office Action issued Dec. 23, 2010 in U.S. Appl. No. 29/334,696.
Int'l Search Report issued on Mar. 17, 2011 in Int'l Application No. PCT/IL2010/000854.
Overview—Silicone Rubber [retrieved from http://www.knovel.com/web/portal/browse/display?_EXT_KNOVEL_DISPLAY_bookid=1023&VerticalID=0 on Feb. 9, 2011].
Int'l Search Report issued on Mar. 17, 2011 in Int'l Application No. PCT/IL2010/00915.
Office Action Issued May 12, 2011 in U.S. Appl. No. 12/063,176.
Office Action issued Jul. 11, 2011 in U.S. Appl. No. 12/293,122.
Int'l Search Report issued Jul. 12, 2011 in Int'l Application No. PCT/IL2011/000187.
Int'l Search Report issued Jul. 12, 2011 in Int'l Application No. PCT/IL2011/000186.
Office Action issued Aug. 3, 2011 in JP Application No. 2008-525719.
Int'l Search Report issued Oct. 7, 2011 in Int'l Application No. PCT/IL2011/000511.
Int'l Search Report issued Mar. 6, 2012 in Int'l Application No. PCT/IL2011/000834; Written Opinion.
Office Action issued Mar. 1, 2012 in JP Application No. 2007-510229.
Int'l Search Report issued Mar. 7, 2012 in Int'l Application No. PCT/IL2011/000829; Written Opinion.
Office Action issued Mar. 13, 2012 in CA Application No. 2,563,643.
Office Action issued Mar. 1, 2012 in CN Application No. 2008801108283.4.
Office Action issued Jan. 2, 2015 in U.S. Appl. No. 29/438,141 by Gilboa.
Office Action issued Jan. 5, 2015 in U.S. Appl. No. 29/413,220 by Lev.
Office Action issued Jan. 7, 2015 in U.S. Appl. No. 29/438,134 by Lev.
U.S. Appl. No. 14/423,595 by Lev, filed Feb. 24, 2015.
U.S. Appl. No. 14/423,612 by Lev, filed Feb. 24, 2015.
Office Action issued Dec. 9, 2015 in U.S. Appl. No. 29/478,723 by Lev.
West, Vial2Bag DC system, Oct. 2, 2014, https://web.archive.org/web/20141002065133/http://www.westpharma.com/en/products/Pages/Reconstitutionsystems.aspx.
Youtube.com, Vial2Bag DC, Aug. 21, 2014, https://www.youtube.com/watch?v=FEOkglxNBrs.
Office Action issued Dec. 9, 2015 in U.S. Appl. No. 29/478,726 by Lev.
Notice of Allowance issued Jan. 12, 2016 in U.S. Appl. No. 14/385,212 by Lev.
Notice of Allowance issued Mar. 17, 2016 in U.S. Appl. No. 29/502,037 by Lev.
Office Action issued Mar. 25, 2016 in U.S. Application No. 29/478,726 by Lev.

TELESCOPIC FEMALE DRUG VIAL ADAPTER

CROSS-REFERENCE TO RELATED APPLICATION

This application is a Section 371 of International Application No. PCT/IL2013/050407, filed Oct. 17, 2012, which was published in the English language on Mar. 20, 2014, under International Publication No. WO 2014/041529 A1, and the disclosure of which is incorporated herein by reference.

FIELD OF THE INVENTION

The invention relates to drug vial adapters in general and female drug vial adapters in particular.

BACKGROUND OF THE INVENTION

Commonly owned PCT International Application No. PCT/IL2006/000912 entitled Liquid Drug Transfer Devices for Failsafe Correct Snap Fitting onto Medicinal Vials and published under PCT International Publication No. WO 2007/017868 illustrates and describes liquid drug transfer devices including a drug vial adapter designed for guided alignment with a drug vial prior to snap fitting thereon and puncturing same for ensuring flow communication with the drug vial's interior. WO 2007/017868 FIG. 4 illustrates a vented female drug vial adapter for use with a needleless syringe.

A WO 2007/017868 drug vial adapter includes a top wall with a downward depending puncturing member and an opposite upright access port in flow communication with the puncturing member. The top wall is also formed with a downward depending generally cylindrical skirt surrounding the puncturing member. The generally cylindrical skirt includes at least four axially directed flex members longer than the puncturing member to avoid the puncturing member contacting a drug vial's drug vial stopper prior to alignment of the drug vial adapter and the drug vial. The axially directed flex members include two non-adjacent drug vial retention flex members for snap fitting over a drug vial opening for drug vial retention purposes and at least two non-adjacent drug vial guidance flex members longer than their counterpart drug vial retention flex members for guiding the drug vial adapter with respect to a drug vial prior to snap fitting thereon.

A WO 2007/017868 vented female drug vial adapter includes a dual lumen puncturing member having a liquid transfer lumen and a venting lumen. The liquid transfer lumen is in flow communication with a female connector for sealingly receiving a needleless syringe. The venting lumen is in flow communication with a generally circular air filter formed in the top wall. Inversion of the vented female drug vial adapter for aspiration of its liquid drug contents leads to liquid drug contents undesirably entering the venting lumen and wetting the air filter therefore considerably detracting from its ability to enable filtered air to pass therethrough for pressure equalization purposes during aspiration.

There is a need for female drug vial adapters for guided alignment relative to a drug vial prior to mounting thereon and puncturing but with a longer puncturing member.

SUMMARY OF THE INVENTION

The present invention is directed toward female drug vial adapters including a dual component construction having a spike component telescopically mounted on a skirt component for manual displacement from a set-up position to an actuated position for snug mounting on and puncturing a drug vial. Manual displacement of the spike component towards the skirt component affords initial guided alignment of the drug vial adapter relative to a drug vial prior to being snugly mounted thereon and puncturing same.

The present invention is particularly advantageous for vented female drug vial adapters which can be provisioned with a long puncturing member having a venting lumen with a venting lumen aperture at its puncturing tip. The vented female drug vial adapters are intended to be used with needleless syringes filled with a predetermined volume of liquid contents such that, on inversion of a vented female drug vial adapter mounted on a drug vial with liquid drug contents for aspiration purposes, the venting lumen aperture is above the liquid level of the liquid drug contents in a manner resembling a swimming snorkel. By virtue of this arrangement, liquid drug contents are precluded from entering the venting lumen and wetting the air filter.

BRIEF DESCRIPTION OF DRAWINGS

In order to understand the invention and to see how it can be carried out in practice, a preferred embodiment will now be described, by way of a non-limiting example only, with reference to the accompanying drawings in which similar parts are likewise numbered, and in which.

DETAILED DESCRIPTION OF PREFERRED EMBODIMENT OF THE INVENTION

Figure 1:
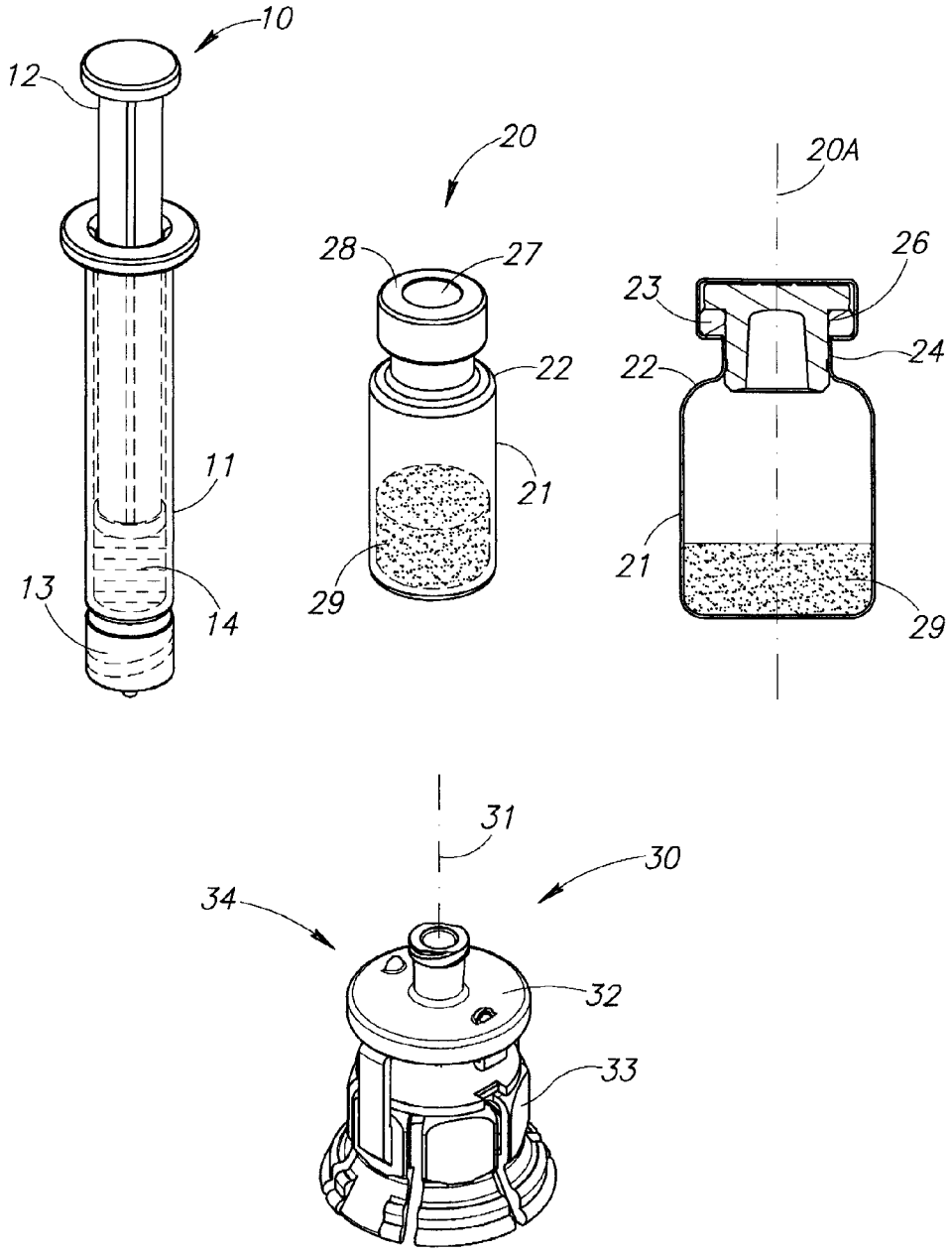
FIG. 1 is a pictorial representation of a syringe, a drug vial including a longitudinal cross section, and a vented telescopic female drug vial adapter having a longitudinal drug vial adapter axis in a set-up position.
Figure 2:
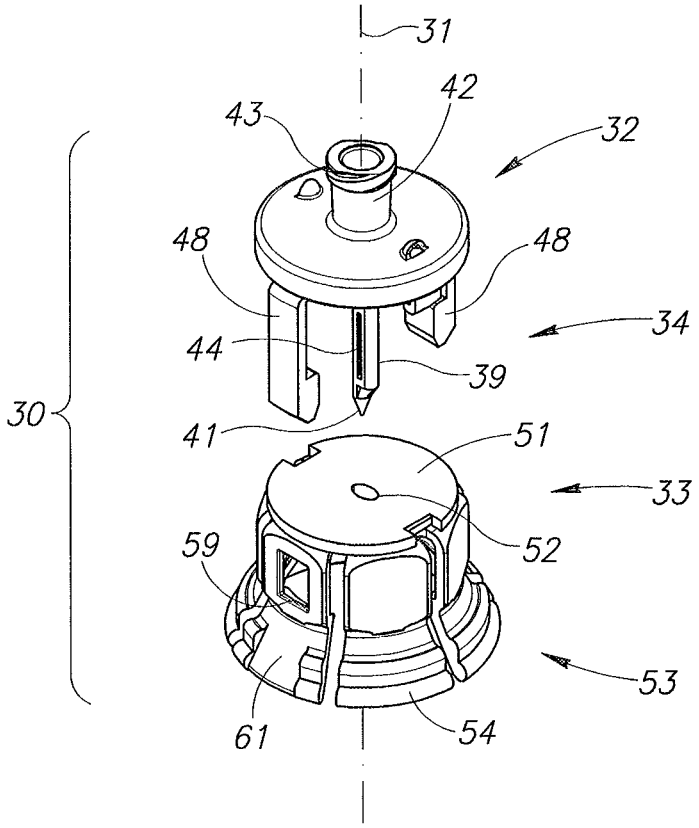
FIG. 2 is an exploded view of the vented telescopic female drug vial adapter.
Figure 3:
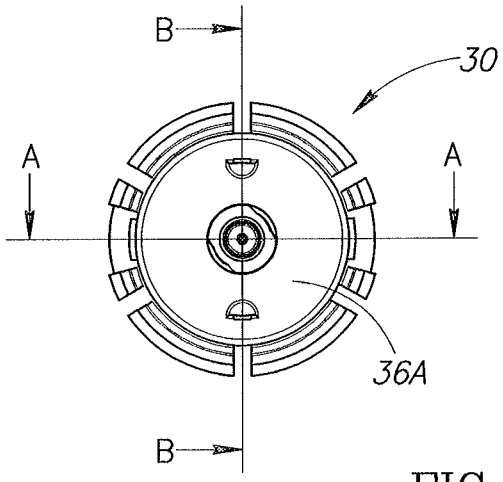
FIG. 3 is a top plan view of the vented telescopic female drug vial adapter along the longitudinal drug vial adapter axis.
Figure 4:
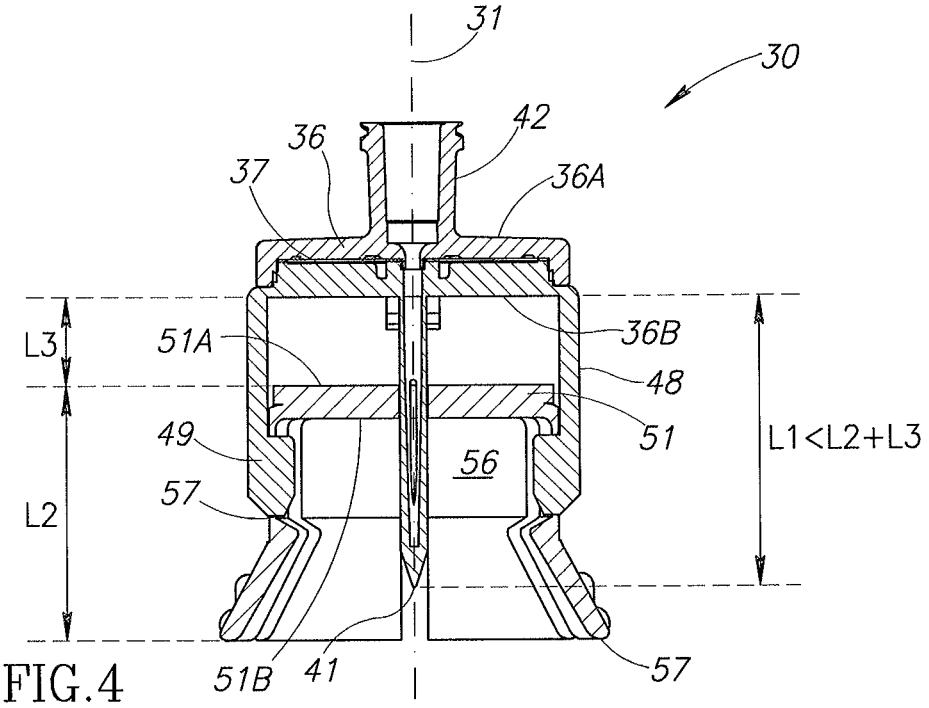
FIG. 4 is a longitudinal cross section of the vented telescopic female drug vial adapter along line A-A in FIG. 3 in a set-up position.
Figure 5:
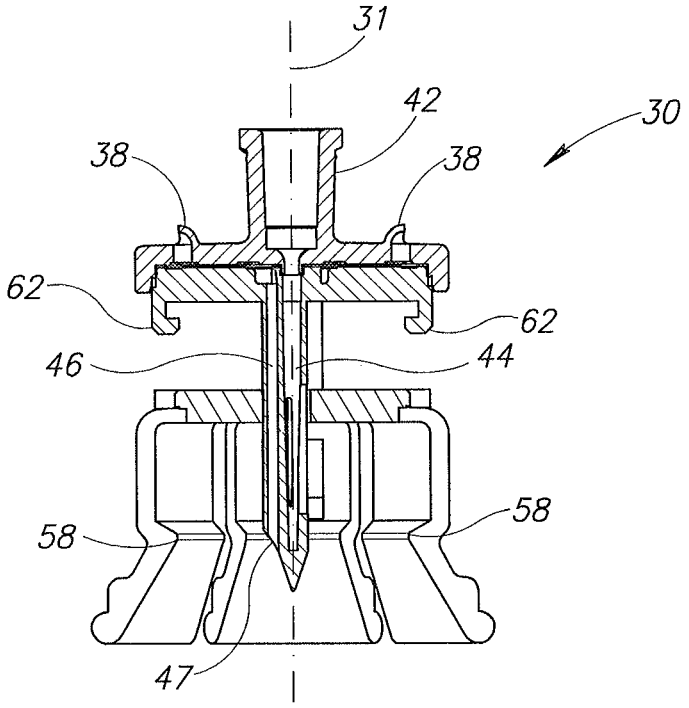
FIG. 5 is a longitudinal cross section of the vented telescopic female drug vial adapter along line B-B in FIG. 3 in its set-up position.

FIG. 1 shows a syringe 10 constituting a source of physiological fluid, a medicinal drug vial 20 and a vented telescopic female drug vial adapter 30 for use with the syringe 10 and the drug vial 20. The syringe 10 includes a barrel 11 with a plunger 12 and a male Luer lock connector 13. The syringe 10 can be formed with other types of male connectors. The syringe 10 is filled with a liquid component 14. The liquid component 14 can be diluent only. Alternatively, the liquid component 14 can include an active component.

The drug vial 20 has a longitudinal drug vial axis 20A and includes a drug vial bottle 21 having a drug vial shoulder 22, a drug vial rim 23 and an intermediate narrow drug vial neck 24. The drug vial rim 23 defines a drug vial opening 26 sealed by a drug vial stopper 27 capped by a band 28. The drug vial 20 contains a powder drug 29 under negative pressure or a liquid drug 29.

Figure 6:
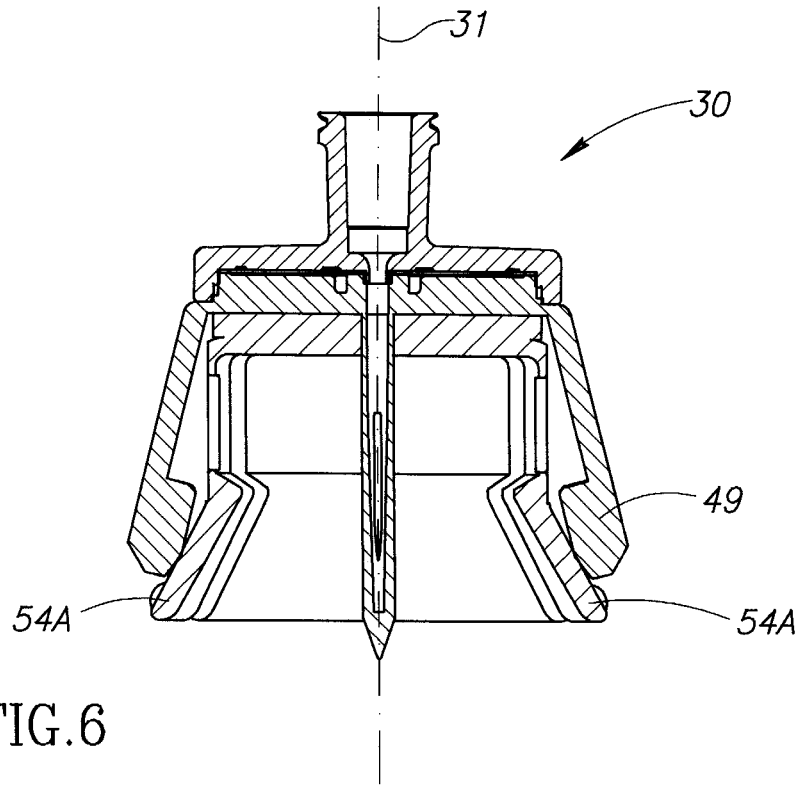
FIG. 6 is a longitudinal cross section of the vented telescopic female drug vial adapter along line A-A in FIG. 3 in an actuated position.
Figure 7:
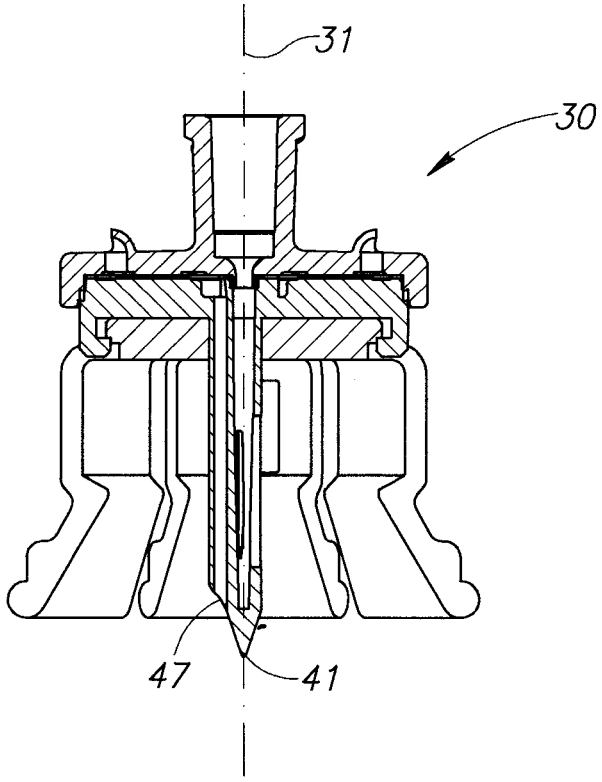
FIG. 7 is a longitudinal cross section of the vented telescopic female drug vial adapter along line B-B in FIG. 3 in its actuated position.

FIGS. 1 to 7 show the vented telescopic female drug vial adapter 30 has a longitudinal drug vial adapter axis 31 and includes a vented spike component 32, a skirt component 33 and a securing arrangement 34 for securing the spike component 32 on the skirt component 33 in an actuated position as shown in FIGS. 6 and 7.

The vented spike component 32 includes a transversely directed spike component top wall 36 having a circular air filter 37 and a pair of vent apertures 38. The vented spike component 32 preferably includes protective hoods 38 as illustrated and described in commonly owned PCT International Application No. PCT/2011/000187 entitled Liquid Drug Transfer Device with Vented Vial Adapter and published under PCT International Publication No. WO 2011/104712.

The spike component top wall 36 includes a downward depending dual lumen puncturing member 39 with a puncturing tip 41 for puncturing a drug vial stopper and an opposite upright female connector 42. The female connector 42 is preferably a female Luer connector with an external screw thread 43. The dual lumen puncturing member 39 includes a liquid transfer lumen 44 in flow communication with the opposite upright female connector 42. The dual lumen puncturing member 39 includes a venting lumen 46 having a venting lumen aperture 47 adjacent the puncturing tip 41 and in flow communication with the pair of vent apertures 38.

The spike component top wall 36 includes an uppermost spike component top wall surface 36A facing the upright female connector 42 and a lowermost spike component top wall surface 36B facing the dual lumen puncturing member 39. The puncturing member 39 has a length L1 defined between the lowermost spike component top wall surface 36B and the puncturing tip 41.

The spike component top wall 36 also includes a pair of opposite spaced apart downward depending spike component legs 48 lateral to the puncturing member 39. The spike component legs 48 terminate at leg tips 49 inwardly protruding toward the puncturing tip 41.

The skirt component 33 includes a transversely directed skirt component top wall 51 having a central aperture 52 and a downward depending substantially cylindrical skirt 53. The skirt 53 includes a multitude of drug vial flex members 54 defining a drug vial rim cavity 56 for snugly receiving the drug vial rim 23 therein and a skirt component margin 57 remote from the skirt component top wall 51. The drug vial flex members 54 preferably include inward directed projections 58 for snap fitting on the drug vial rim 23.

The skirt component top wall 51 includes an uppermost skirt component top wall surface 51A facing the spike component 32 and a lowermost skirt component top wall surface 51B facing the skirt 53. The skirt 53 has a length L2 defined between the uppermost skirt component top wall surface 51A and the skirt component margin 57.

Two opposite drug vial flex members 54A have leg tip apertures 59 for initially receiving the leg tips 49 for initially spacing the spike component top wall 36 from the skirt component top wall 51 with the puncturing member 39 protruding through the central aperture 52 in a set-up position of the telescopic female drug vial adapter 30. The drug vial flex members 54A are preferably formed with smooth outside surfaces 61 beneath the leg tip apertures 59 to enable smooth sliding movement of the legs tips 49 towards the skirt component margin 57.

In the set-up position, the lowermost spike component top wall surface 36B and the uppermost skirt component top wall surface 51A are separated by a length L3. In the set-up position, L1<L2+L3 such that the puncturing tip 41 does not protrude beyond the skirt component margin 57 which would lead to the puncturing tip 41 contacting a drug vial stopper 27 prior to correct alignment of the vented telescopic female drug vial adapter 30 with a drug vial 20. The puncturing member 39 and the skirt 53 are preferably dimensioned such that L1>L2 such that the venting tip aperture 47 protrudes beyond the skirt component margin 57 in the actuated position in which the spike component 32 fully abuts the skirt component 33.

The securing arrangement 34 includes a pair of opposite snap fit clips 62 orthogonal to the pair of opposite spike component legs 48.

FIGS. 8A to 8G show the use of the needleless syringe 10, the drug vial 20 and the vented telescopic female drug vial adapter 30. The needleless syringe 10 is filled with a predetermined volume of liquid contents 29 to ensure a snorkel like effect such that liquid contents do not wet the circular air filter 37 as described hereinbelow with respect to FIG. 8G.

Figure 8A:
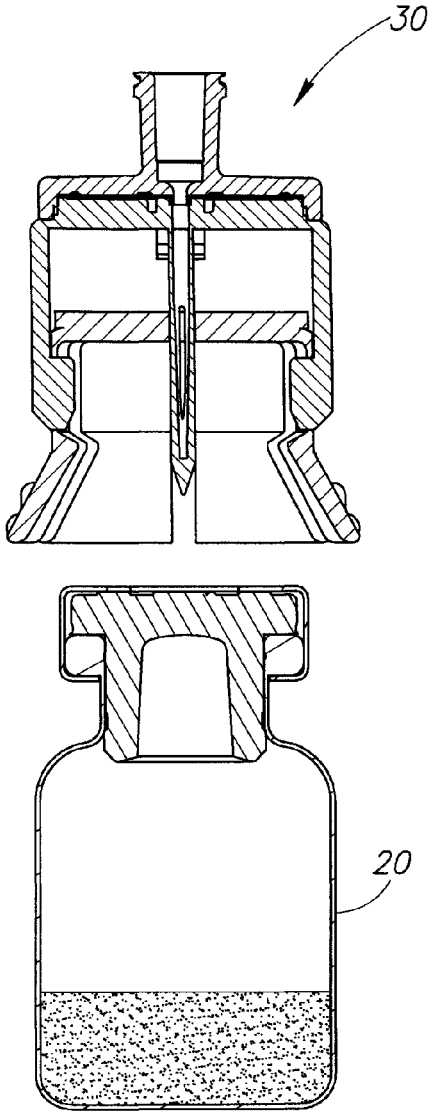
FIG. 8A is a longitudinal cross section of the vented telescopic female drug vial adapter and the drug vial along line A-A in FIG. 3 prior to use.

FIG. 8A shows the female drug vial adapter 30 in its set-up position and in co-axial alignment with the drug vial 20 ready for snap fitting thereon and puncturing same.

Figure 8B:
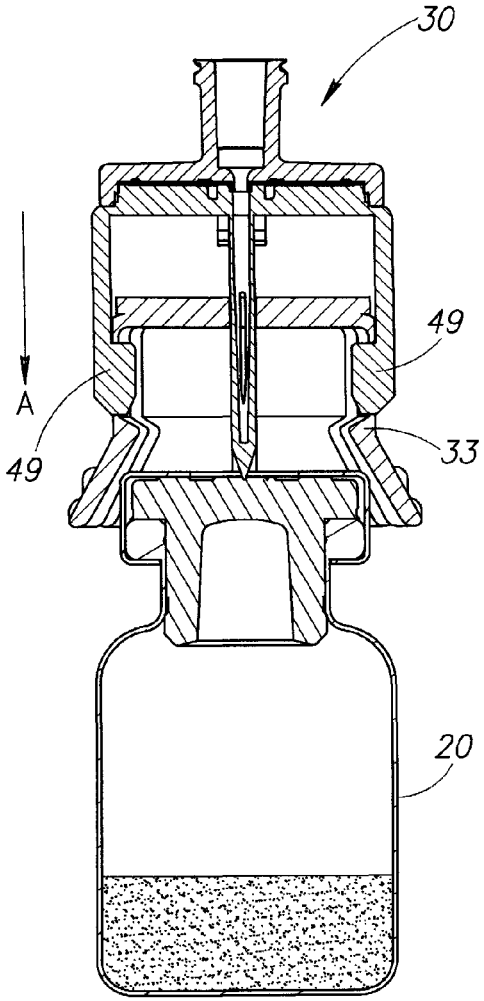
FIG. 8B is a longitudinal cross section of the vented telescopic female drug vial adapter and the drug vial along line A-A in FIG. 3 pursuant to an initial downward depression of the former toward the latter.

FIG. 8B shows an initial downward depression of the female drug vial adapter 30 toward the drug vial 20 as denoted by arrow A. The leg tips 49 impart a downward force to the skirt component 33. The flex members 54 ensure the spike component 32 is aligned with the skirt component 33 in case of misalignment before the puncturing tip 41 starts puncturing the drug vial stopper 27.

Figure 8E:
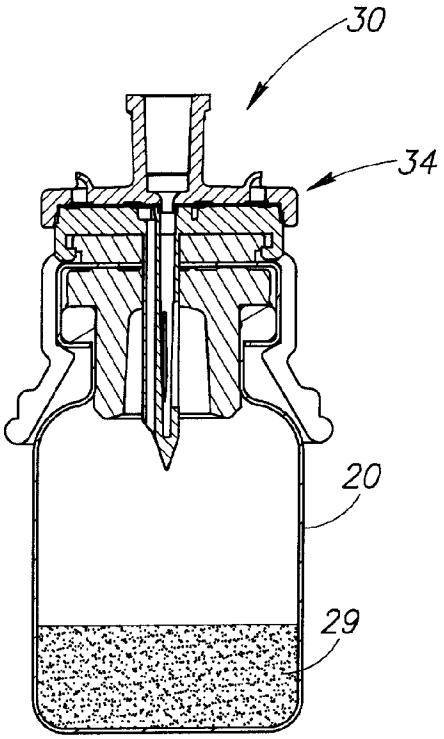
FIG. 8E is a longitudinal cross section of the vented telescopic female drug vial adapter fully mounted on and puncturing the drug vial along line B-B in FIG. 3.
Figure 8D:
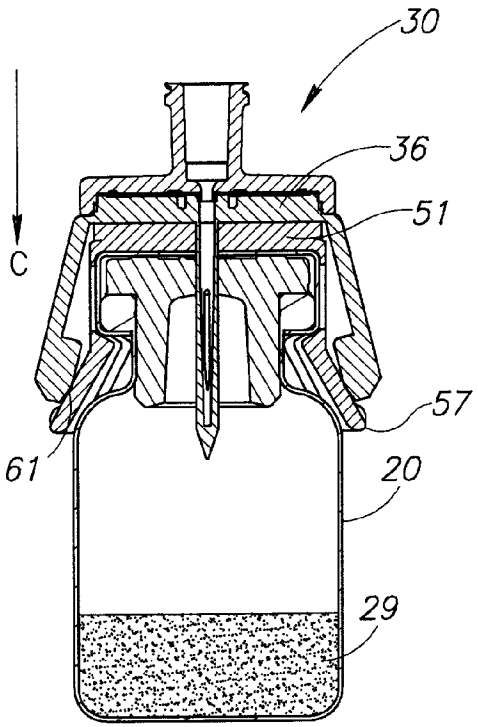
FIG. 8D is a longitudinal cross section of the vented telescopic female drug vial adapter fully mounted on and puncturing the drug vial along line A-A in FIG. 3.
Figure 8C:
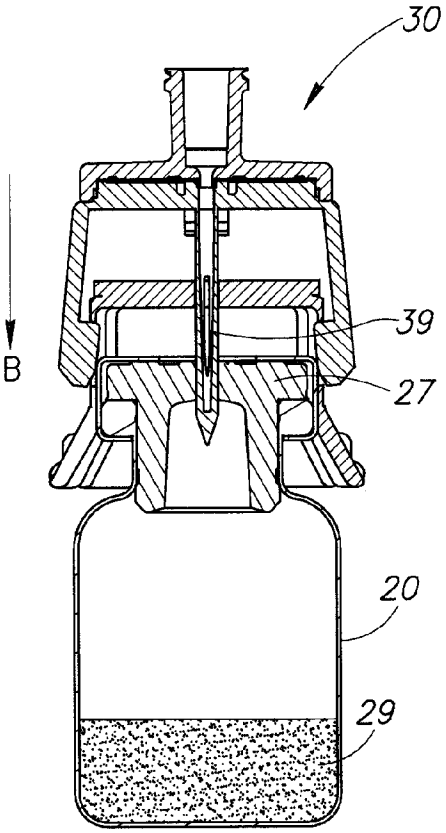
FIG. 8C is a longitudinal cross section of the vented telescopic female drug vial adapter and the drug vial along line A-A in FIG. 3 pursuant to continuing downward depression of the former toward the latter.

FIG. 8C shows continuing downward depression of the drug vial adapter 30 towards the drug vial 20 as denoted by arrow B causes the puncturing member 39 to puncture the drug vial stopper 27. The drug vial 20 urges the leg tips 49 radial outward from the leg tip apertures 59. In the case of negative pressure drug vial 20, air enters the drug vial 20 via both the liquid transfer lumen 44 and the venting lumen 46.

FIGS. 8D and 8E show complete downward depression of the drug vial adapter 30 towards the drug vial 20 until the former 30 snap fits on and punctures the drug vial stopper 27 as denoted by arrow C. The spike component 32 stops against the skirt component 33. The leg tips 49 slide along the smooth external surfaces 61 towards the skirt component margin 57.

The securing arrangement 34 is engaged to secure the drug vial adapter 30 and the drug vial 20.

Figure 8F:
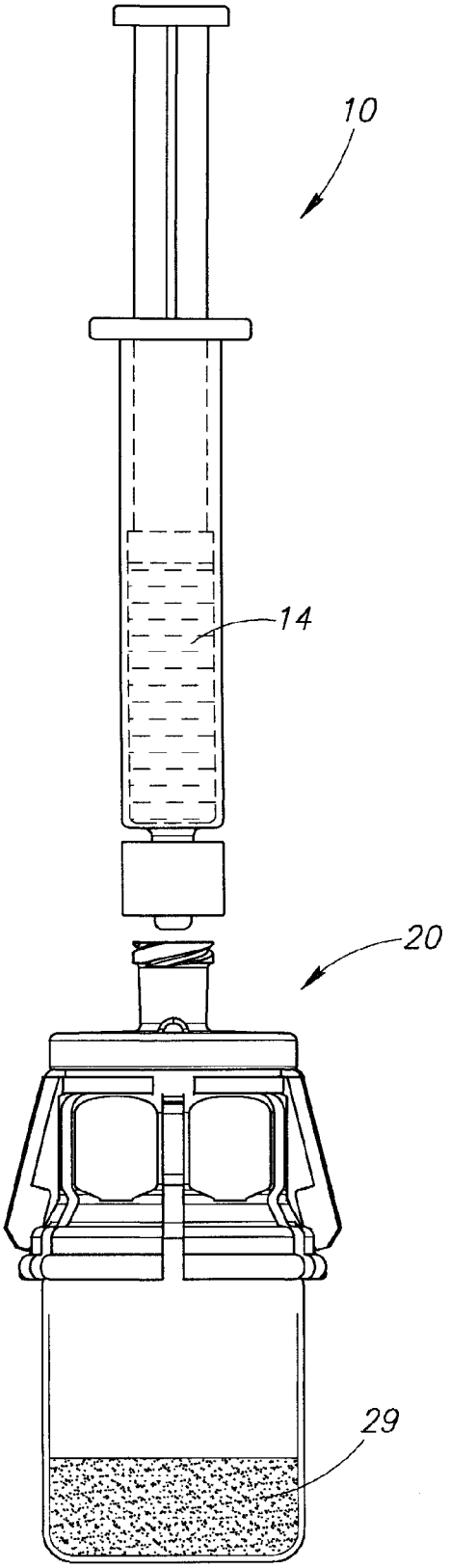
FIG. 8F is a longitudinal cross section of the vented telescopic female drug vial adapter and the drug vial along line A-A in FIG. 3 on screw threading a needleless syringe on the former for injection purposes.

FIG. 8F shows the syringe 10 ready for screw thread mounting on the female drug vial adapter 30 for injection of its liquid contents 29. The assemblage of the syringe 10, the drug vial 20 and the female drug vial adapter 30 is gently agitated to ensure complete reconstitution of powder contents. On injection of the liquid contents, air exits from the drug vial 20 via the venting lumen 46 and the vent apertures 38.

Figure 8G:
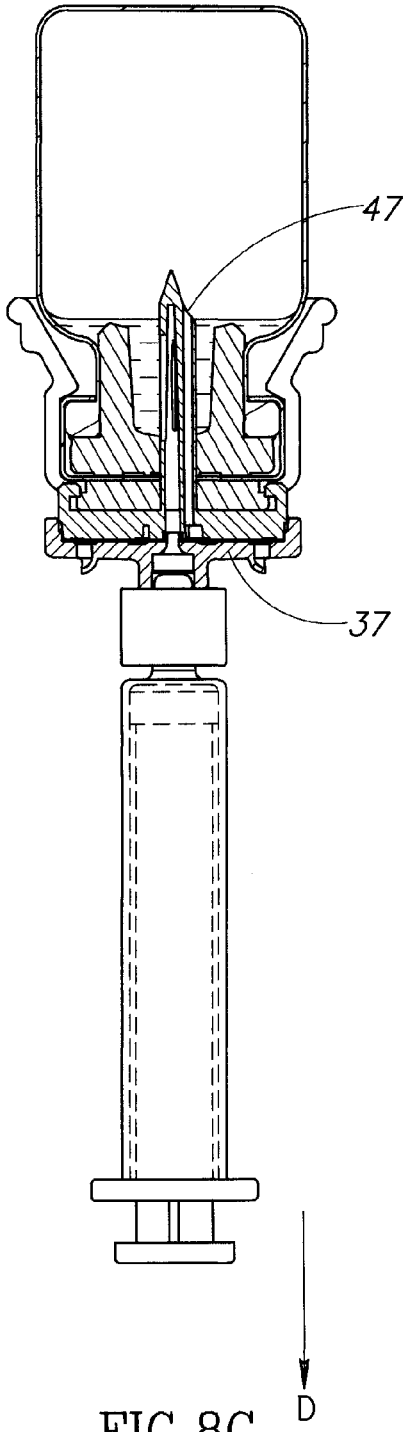
FIG. 8G is a longitudinal cross section of the vented telescopic female drug vial adapter and the drug vial along line A-A in FIG. 3 after inversion for aspiration purposes.

FIG. 8G shows inversion of FIG. 8F's assemblage for aspiration of the liquid drug contents from the drug vial 20 to the syringe 10 as denoted by arrow D for administration purposes. The venting lumen aperture 47 is above the liquid level of the drug liquid contents to resemble a swimming snorkel such that the air filter 37 is not wetted. Air is drawn into the drug vial 20 via the vent apertures 38, the air filter 37 and the venting lumen 46.

While the invention has been described with respect to a limited number of embodiments, it will be appreciated that many variations, modifications, and other applications of the invention can be made within the scope of the appended claims.

The invention claimed is:

1. A telescopic female drug vial adapter for use with a drug vial including a drug vial bottle containing a medicament, and a drug vial rim defining a drug vial opening stopped by a drug vial stopper, the drug vial adapter having a longitudinal drug vial adapter axis and comprising:

(a) a spike component including a transversely directed spike component top wall having i) a downward depending puncturing member with a puncturing tip for puncturing the drug vial stopper and an opposite upright female connector in flow communication with said puncturing member, and ii) at least two spaced apart downward depending spike component legs lateral to said puncturing member, said at least two spike component legs terminating at leg tips inwardly protruding toward said puncturing tip; and (b) a skirt component including a transversely directed skirt component top wall having a central aperture, a downward depending substantially cylindrical skirt of a multitude of drug vial flex members and a skirt component margin remote from said skirt component top wall, said multitude of drug vial flex members defining a drug vial rim cavity for snugly receiving the drug vial rim therein, said at least two drug vial flex members having leg tip apertures for initially receiving said leg tips in a set-up position of the telescopic female drug vial adapter for initially spacing said spike component top wall from said skirt component top wall with said puncturing member protruding through said central aperture, the arrangement being such that on urging the drug vial adapter towards a drug vial positioned below said drug vial adapter and manual sliding displacement of said spike component towards said skirt component for stopping thereagainst in an actuated position of the telescopic female drug vial adapter, said drug vial flex members snugly receive the drug vial rim in said drug vial rim cavity, said puncturing member punctures the drug vial stopper and said leg tips are urged radially outward from their corresponding leg tip apertures to slide downward along their corresponding drug vial flex members towards said skirt component margin.

2. The adapter according to claim 1 further comprising a securing arrangement for securing said spike component on said skirt component in said actuated position.

3. The adapter according to claim 2 wherein said spike component includes a pair of opposite spike component legs and said securing arrangement includes a pair of opposite snap fit clips orthogonal to said pair of opposite spike component legs.

4. The adapter according to claim 1 wherein said puncturing member protrudes beyond said skirt component margin in said actuated position.

5. The adapter according to claim 1 wherein said spike component is vented, said spike component top wall includes a circular air filter and at least one vent aperture, and said puncturing member includes a liquid transfer lumen in flow communication with said opposite upright female connector and a venting lumen in flow communication with said air filter, and said venting lumen includes a venting lumen aperture adjacent said puncturing member tip.

* * * * *